US009205678B2

(12) United States Patent
Kitada et al.

(10) Patent No.: US 9,205,678 B2
(45) Date of Patent: Dec. 8, 2015

(54) INK JET PRINTER

(71) Applicant: Seiko Epson Corporation, Tokyo (JP)

(72) Inventors: Kenji Kitada, Matsumoto (JP); Takuya Miyakawa, Matsumoto (JP); Takashi Saiba, Shiojiri (JP); Kiyofumi Kitawada, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/681,548

(22) Filed: Apr. 8, 2015

(65) Prior Publication Data

US 2015/0290952 A1 Oct. 15, 2015

(30) Foreign Application Priority Data

Apr. 9, 2014 (JP) ..... 2014-080519

(51) Int. Cl.

| | |
|---|---|
| ***B41J 2/01*** | (2006.01) |
| ***B41J 11/00*** | (2006.01) |
| *B41M 5/52* | (2006.01) |
| *B41M 7/00* | (2006.01) |

(52) U.S. Cl.

CPC ..... *B41J 11/002* (2013.01); *B41M 7/0045* (2013.01); *B41M 5/5209* (2013.01); *B41M 7/0018* (2013.01)

(58) Field of Classification Search

None

See application file for complete search history.

(56) References Cited

U.S. PATENT DOCUMENTS

| | | | | |
|---|---|---|---|---|
| 8,186,823 | B2 | 5/2012 | Saitoh et al. | |
| 2004/0135828 | A1 | 7/2004 | Schmitt et al. | |
| 2009/0207224 | A1 | 8/2009 | Cofler | |
| 2015/0202894 | A1 * | 7/2015 | Kitada et al. ..... | 347/102 |

FOREIGN PATENT DOCUMENTS

| | | | |
|---|---|---|---|
| JP | 2009-279796 | A | 12/2009 |
| JP | 2012066497 | A * | 4/2012 |
| JP | 2012-179747 | A | 9/2012 |
| JP | 2012-179748 | A | 9/2012 |

OTHER PUBLICATIONS

Machine Translation of JP2012066497A "Inkjet type image forming apparatus", Iwase, F, Apr. 5, 2012, paragraphs 0022, 0034-0036, 0038-0039, 0044-0045, 0057, 0059.*

Extended European Search Report for Application No. EP 15 16 2836 dated Aug. 26, 2015 (6 pages).

* cited by examiner

*Primary Examiner* — Lisa M Solomon

(74) *Attorney, Agent, or Firm* — Harness, Dickey & Pierce, P.L.C.

(57) ABSTRACT

An ink jet printer including a transportation mechanism transporting a medium in a first direction; and a carriage having a plasma irradiation mechanism that irradiates a portion of the medium with plasma generated in an electricity discharge portion and emitted from a plasma irradiation opening and a head that ejects ink from a nozzle to the plasma irradiated portion of the medium, and that moves in a second direction intersecting the first direction. The plasma irradiation mechanism is on one side of the head in the second direction, a partition board is between the plasma irradiation opening and the head, and if a distance from the medium's surface to the nozzle is (A), a distance from the medium's surface to the plasma irradiation opening is (B), and a distance from the medium's surface to the bottom edge of the partition board is (C), then (C)<(A)≤(B).

16 Claims, 8 Drawing Sheets

INK JET PRINTER

BACKGROUND

1. Technical Field

The present invention relates to an ink jet printer.

2. Related Art

In the related art, a printing method using an ink jet printer is performed by causing small ink droplets to fly and become attached to a medium such as paper. According to the innovative progress of the ink jet printing technology, printing is performed by an ink jet printer on cloth to which ink is highly absorbable such as silk, polyester, or cotton, or on a plastic medium to which ink is not absorbable.

There has been known a technique in which when printing is performed on the plastic medium by the ink jet printer, the surface of the medium is reformed by irradiating the surface with plasma, and the compatibility between the medium and the ink is enhanced (for example, see JP-A-2009-279796, JP-A-2012-179748, and JP-A-2012-179747).

JP-A-2009-279796 and JP-A-2012-179748 disclose plasma irradiation mechanisms provided to be separate from carriages. The plasma irradiation mechanisms disclosed in JP-A-2009-279796 and JP-A-2012-179748 each include a pair of electrodes that interpose mediums, and perform a surface treatment by causing plasma generated between the electrodes to come into contact with the medium.

JP-A-2012-179747 discloses a plasma irradiation mechanism mounted on a carriage, and discloses a plasma irradiation mechanism disposed in a direction perpendicular to a movement direction of the carriage (for example, see paragraph 0012). The plasma irradiation mechanism disclosed in JP-A-2012-179747 generates plasma between a pair of electrodes (4 and 5) disposed on the same side of a medium, and performs a surface treatment by causing the plasma to come into contact with the medium (for example, see paragraph 0015).

As described above, in JP-A-2009-279796, J-PA-2012-179748, and JP-A-2012-179747, surface treatments are performed by a so-called direct type, in which a discharger is caused to come into direct contact with the medium. The direct type is a method of generating plasma in a state in which a work piece is disposed between the electrodes and performing surface treatment on the work piece.

However, in the surface treatment by the direct type, the medium may be damaged or discolored.

SUMMARY

An advantage of some aspects of the invention is to provide an ink jet printer and a printing method that can suppress at least any one of the damage and the discoloration of a medium when surface modification of the medium is performed by plasma irradiation.

According to an aspect of the invention, there is provided a printer including a transportation mechanism that transports a medium in a first direction; and a carriage that has a plasma irradiation mechanism configured to irradiate at least a portion of the medium with plasma generated in an electricity discharge portion and emitted from a plasma irradiation opening and a head configured to eject ink from a nozzle to the portion of the medium irradiated with the plasma, and that moves in a second direction intersecting the first direction.

According to a first aspect of the invention, the plasma irradiation mechanism is provided on one side of the head in the second direction. In addition, according to a second aspect of the invention, the plasma irradiation mechanism is provided on both sides of the head in the second direction. A partition board is provided between the plasma irradiation opening and the head. If a distance from a surface of the medium to the nozzle is (A), a distance from a surface of the medium to the plasma irradiation opening is (B), and a distance from a surface of the medium to the partition board is (C), the printer according to the invention satisfies a conditional expression: $(C)<(A)\leq(B)$.

The printer preferably satisfies a conditional expression: $0.5\ \text{mm}\leq(C)<(A)\leq(B)\leq10\ \text{mm}$.

If the shortest distance between the nozzle and the partition board is (D) and the shortest distance between the nozzle and the plasma irradiation opening is (E), a conditional expression: $5\ \text{mm}\leq(D)<(E)\leq500\ \text{mm}$ is preferably satisfied.

The partition board is preferably disposed to correspond to the plasma irradiation opening.

A length of the partition board in the first direction is preferably longer than that of the head in the first direction.

The plasma irradiation opening of the plasma irradiation mechanism may be a spot type. In the printer according to the first aspect of the invention, a plurality of the spot type plasma irradiation openings are disposed on one side of the head, in a line in the first direction. In the printer according to the second aspect of the invention, a plurality of the spot type plasma irradiation openings are disposed on both sides of the head, in a line in the first direction. In addition, a plurality of the partition boards may be disposed to correspond to the plurality of the spot type plasma irradiation openings, respectively.

The electricity discharge portion of the plasma irradiation mechanism is preferably disposed so as not to be in contact with the medium.

The same portion of the medium is preferably irradiated with the plasma at least twice before the ink is attached.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
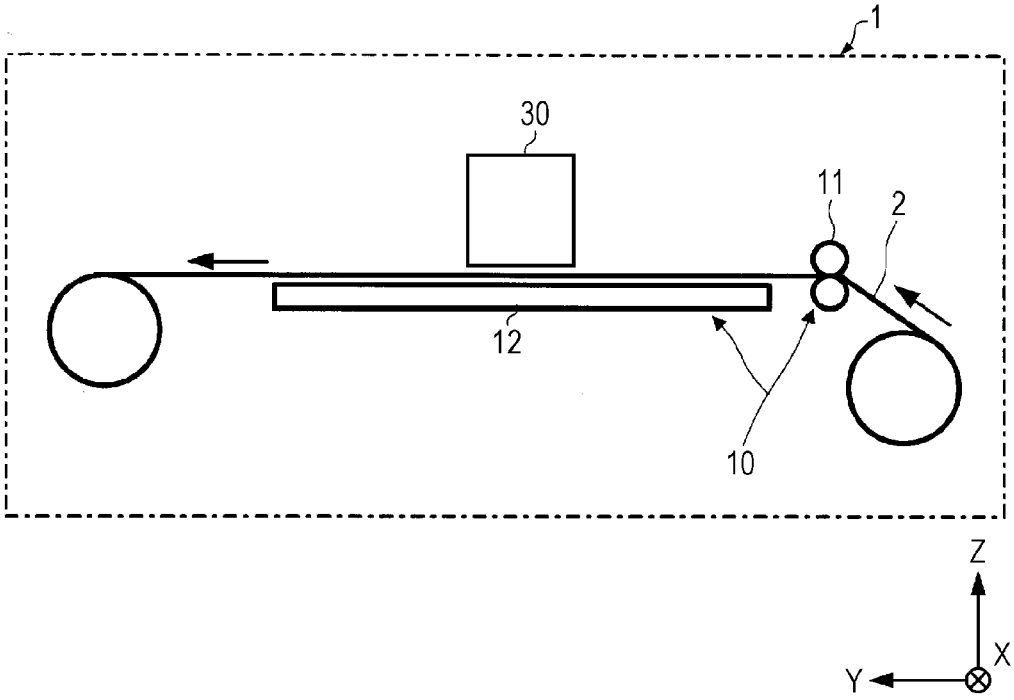
FIG. 1 is a diagram schematically illustrating an ink jet printer according to a first embodiment.

Hereinafter, embodiments according to the invention are described in detail. In addition, the invention is not limited to the embodiments described below, and can be modified in various ways without departing from the gist of the invention. In the description below, three orthogonal directions are referred to as X, Y, and Z directions. In addition, the Z direction is the vertical direction, and the Y direction is the transportation direction of a medium. The vertically upward direction is the +Z direction and the downward direction is the −Z direction. In the drawings, three directions corresponding thereto are illustrated.

Ink Jet Printer

FIG. 1 is a diagram schematically illustrating an ink jet printer according to the first embodiment. An ink jet printer 1 includes a transportation mechanism 10 that transports a medium 2 in the Y direction (first direction) and a carriage 30 that moves and prints in the X direction (second direction) intersecting the Y direction.

The ink jet printer 1 according to the first embodiment has a control unit (not illustrated) that controls overall operations of the ink jet printer. The control unit is installed at an arbitrary position of the ink jet printer 1, and controls operations of the respective units based on information input from an input unit such as a PC or a touch panel.

For example, the transportation mechanism 10 includes rollers 11 and a platen 12. In addition, the positions and the number of the rollers 11 are not limited. The platen 12 supports the medium 2 on the side opposite to the surface on which an image is printed on the medium 2. The platen 12 may include a heater therein.

Though not illustrated, a drying mechanism that dries a solvent of the ink may be provided on the backward side of the carriage 30 (+Y direction side of the carriage 30) in the transportation direction of the medium 2. For example, the drying mechanism may have a heater or a blowing mechanism.

As described below, the kind of the ink is not particularly limited, and various additional mechanisms may be included depending on the kind of ink. For example, if the ink is ultraviolet ray curable ink, an ultraviolet ray irradiation mechanism may be provided on the backward side of the carriage 30 (+Y direction side of the carriage 30) in the transportation direction of the medium 2. In addition, if the medium 2 is cloth, a mechanism that applies pretreatment liquid for causing ink to be fixed on the cloth may be provided on the forward side of the carriage 30 in the transportation direction of the medium (−Y direction of the carriage 30). In this manner, various additional mechanisms in addition to the carriage can be included depending on the kind of the medium or the ink.

Figure 2:
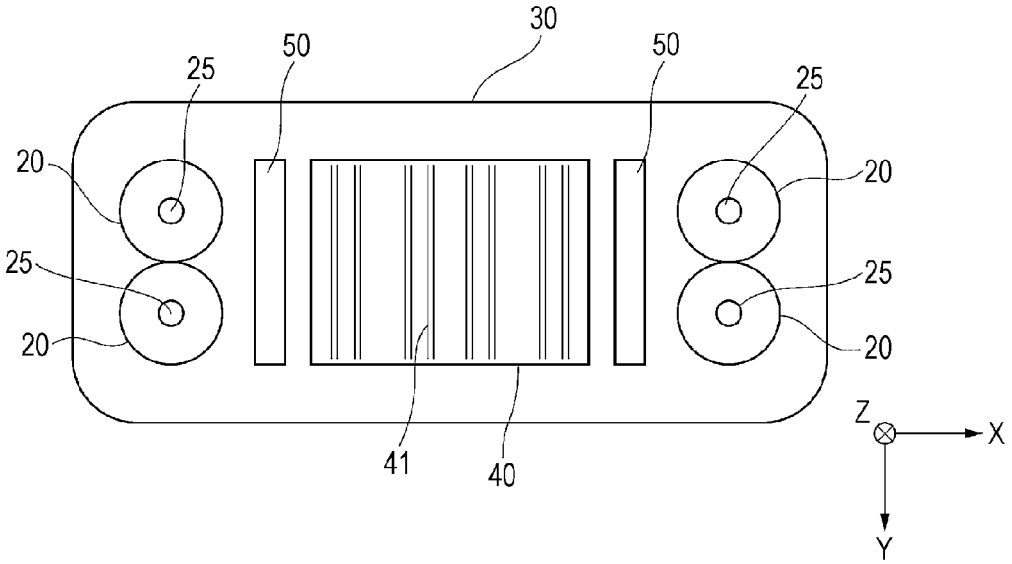
FIG. 2 is a bottom view schematically illustrating a configuration of a carriage.

FIG. 2 is a bottom view schematically illustrating a configuration of the carriage 30. As illustrated in FIG. 2, the carriage 30 includes plasma irradiation mechanisms 20 that emits plasma generated in an electricity discharge portion from a plasma irradiation opening so that at least a portion of the medium is irradiated with the plasma, a head 40 that ejects the ink to the portion of the medium irradiated with the plasma, and partition boards 50 that prevent the influence of plasma or gas emitted from the plasma irradiation mechanisms 20 on the head 40.

The plasma irradiation mechanisms 20 are provided on both sides of the head 40 in the X direction (+X direction side and −X direction side). The plasma irradiation mechanisms 20 illustrated in FIG. 2 are spot-type plasma irradiation mechanisms (also referred to as jet-type plasma irradiation mechanisms). The plasma irradiation mechanisms are classified into the spot-type plasma irradiation mechanisms (also referred to as the jet-type plasma irradiation mechanisms) and line-type plasma irradiation mechanisms depending on the shape of the plasma irradiation opening. The plasma irradiation opening of the former has a diameter in which the lengths are approximately the same in the X direction and the Y direction, and has a spot shape. The plasma irradiation opening of the latter has a diameter in which the length in any one of the X and Y directions is longer, and has a line shape that extends in the corresponding direction. The spot-type plasma irradiation mechanism has an advantage of having many options of the types of the gas. However, as described below, the plasma irradiation mechanisms 20 may be the line type.

As illustrated in FIG. 2, two spot-type plasma irradiation mechanisms 20 (plasma irradiation openings 25) are arranged on each side of the head 40. Two of the plasma irradiation mechanisms 20 (the plasma irradiation openings 25) may be arranged in a line in the transportation direction (Y direction) of the medium 2. In the first embodiment, two of the spot-type plasma irradiation mechanisms 20 (the plasma irradiation openings 25) are arranged on each side of the head 40, but three or more of the spot-type plasma irradiation mechanisms 20 may be arranged.

The head 40 is a unit that forms an image by attaching droplets of the ink on the surface of the medium 2. The head 40 has plural nozzle arrays configured with plural nozzles 41 that eject ink. One nozzle array is configured with the plural nozzles 41 that are arranged in a direction (Y direction) intersecting the movement direction (X direction) of the carriage. The plural nozzle arrays are arranged in the movement direction (X direction) of the carriage. For example, the ink in the same composition is ejected from one nozzle array.

A method of ejecting the ink from the nozzles 41 of the head 40 is, for example, as follows. Specifically, a method of applying a strong electric field between nozzles and acceleration electrodes positioned on the forward side of the nozzles, continuously ejecting droplet-shaped ink from the nozzles, and applying recording information signals to a deflection electrode while droplets of the ink fly between the deflection electrodes to perform recording, a method of ejecting droplets of the ink without deflection in response to the recording information signals (electrostatic suction type), a method of compulsorily ejecting droplets of the ink by applying pressure to the ink with a small pump and mechanically vibrating the nozzles with an quartz oscillator or the like, a method of ejecting and recording droplets of the ink by simultaneously applying the pressure and recording information signals to the ink with a piezoelectric element (piezo type), a method of ejecting and recording droplets of the ink by heating and foaming the ink with fine electrodes in response to recording information signals (thermal jet type), and the like are included.

The head 40 is a serial-type recording head. The serial-type recording head prints an image by performing scanning (pass) several times in which ink is ejected while the recording head moves in a direction (X direction) intersecting the transportation direction of the medium. In this manner, the ink jet printer according to the first embodiment is a so-called serial printer.

The partition boards 50 prevents the exposure of the head 40 to the plasma generated by the plasma irradiation mechanisms 20, and suppresses the generation of the wind ripple unevenness by gas flows generated from the plasma irradiation mechanisms 20. The shapes of the partition boards 50 are not limited, but the partition boards 50 may be formed with insulating materials or metal materials. In order to prevent the partition boards 50 from being charged by the exposure to the plasma, the partition board may be fixed to a ground potential. If the partition boards 50 are charged, the trajectory of the ink droplets ejected from the head 40 may be influenced.

Figure 3:
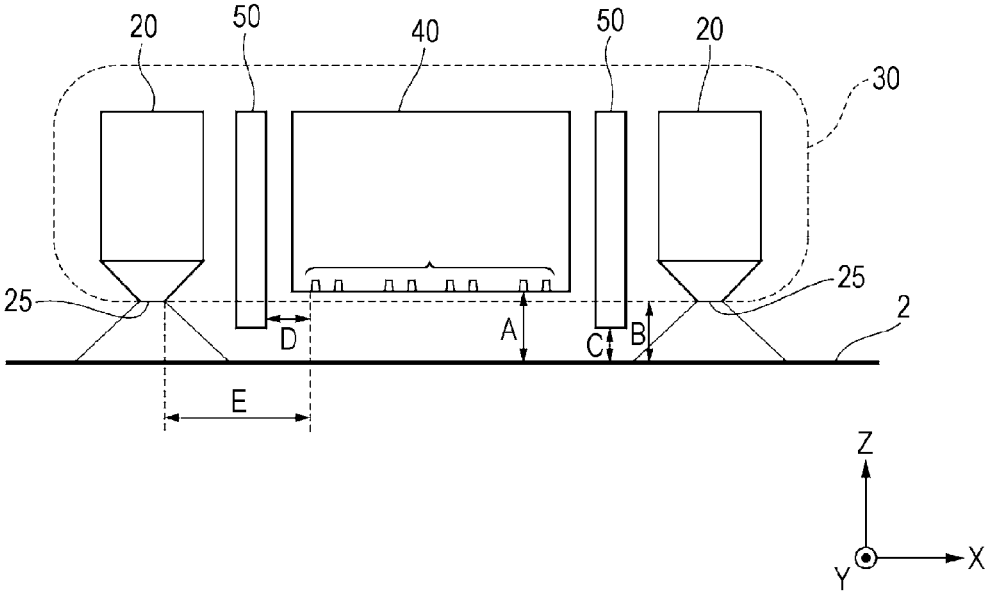
FIG. 3 is a side view schematically illustrating a configuration of the carriage.

FIG. 3 is a side view schematically illustrating a configuration of a carriage.

As illustrated in FIG. 3, when printing is performed, the carriage 30 is arranged to be close to the medium 2. The plasma irradiation openings 25 of the plasma irradiation mechanisms 20 and the nozzles 41 of the head 40 are arranged to face the medium 2.

The plasma irradiation mechanism 20 is a so-called remote-type plasma irradiation mechanism that irradiates at least a portion of the medium 2 emitted from the plasma irradiation openings 25 with the plasma generated by the electricity discharge portion. The plasma irradiation mechanism using the atmospheric pressure plasma is classified into a direct type or a remote type. The direct type is a type in which the plasma irradiation is performed in a state in which the electricity discharge portion generated between the electrodes is in direct contact with the base material, and the expression "the electricity discharge portion is in direct contact with the base material" means, for example, disposing a work piece (medium in the first embodiment) between electrodes to perform a plasma treatment. The remote type is a type in which a treatment is performed by spraying the plasma generated between the electrodes to the work piece. If the direct type is employed, there is a disadvantage in that the medium 2 is exposed to the electricity discharge portion (discharging area) between the electrodes so that the medium 2 is damaged. According to the first embodiment, if the remote type is employed, the medium 2 is not exposed to the electricity discharge portions of the plasma irradiation mechanisms 20 and the defect and the discoloration of the medium are prevented, so that the enhancement of the print quality can be achieved.

According to the first embodiment, if a distance from the surface of the medium 2 to the nozzles 41 is (A), a distance from the surface of the medium 2 to the plasma irradiation opening is (B), and a distance from the surface of the medium 2 to the bottom edge of the partition boards 50 is (C), the distances are regulated to satisfy the relationship of $(C)<(A)\leq(B)$. In this manner, if the distance (C) is caused to be shorter than the distance (A) and the distance (B), the plasma generated by the plasma irradiation mechanisms 20 can be prevented from reaching the nozzles 41 of the head 40, and the damage of the head 40 can be decreased. In addition, the trajectory of the ink droplet can be prevented from being curved by the gas flow generated from the plasma irradiation mechanisms 20 so that the generation of the wind ripple unevenness can be suppressed.

In addition, the ink jet printer 1 according to the first embodiment preferably satisfies the relationship of $0.5\text{ mm}\leq(C)<(A)\leq(B)\leq10\text{ mm}$. If the distance (C) is smaller than 0.5 mm, the partition boards 50 come into contact with the ink coated surface on the medium 2 so that the image may be scratched. In addition, if the distance (B) is greater than 10 mm, the plasma does not work on the medium 2, so that the effect of the surface modification may not be sufficiently obtained. In addition, if the distance (B) is too short, the electricity discharge portions of the plasma irradiation mechanisms 20 are in contact with the medium 2 so that the medium 2 can be discolored due to discharge damages.

Further, if the shortest distance between the nozzles 41 and the partition boards 50 is (D), the shortest distance between the nozzles 41 and the plasma irradiation openings 25 is (E), the distances preferably satisfy the relationship of $5\text{ mm}\leq(D)<(E)\leq500\text{ mm}$. If the distance (D) is shorter than 5 mm, the ink may be blocked by the partition boards 50 so as not to reach the medium 2. In addition, the ink blocked by the partition boards 50 may be attached to the partition boards 50 so as to make the partition boards 50 dirty or to be dropped to a wrong position of the medium 2. In addition, if the distance (D) or the distance (E) is longer than 500 mm, the carriage becomes large so that the printer becomes large.

Figure 4:
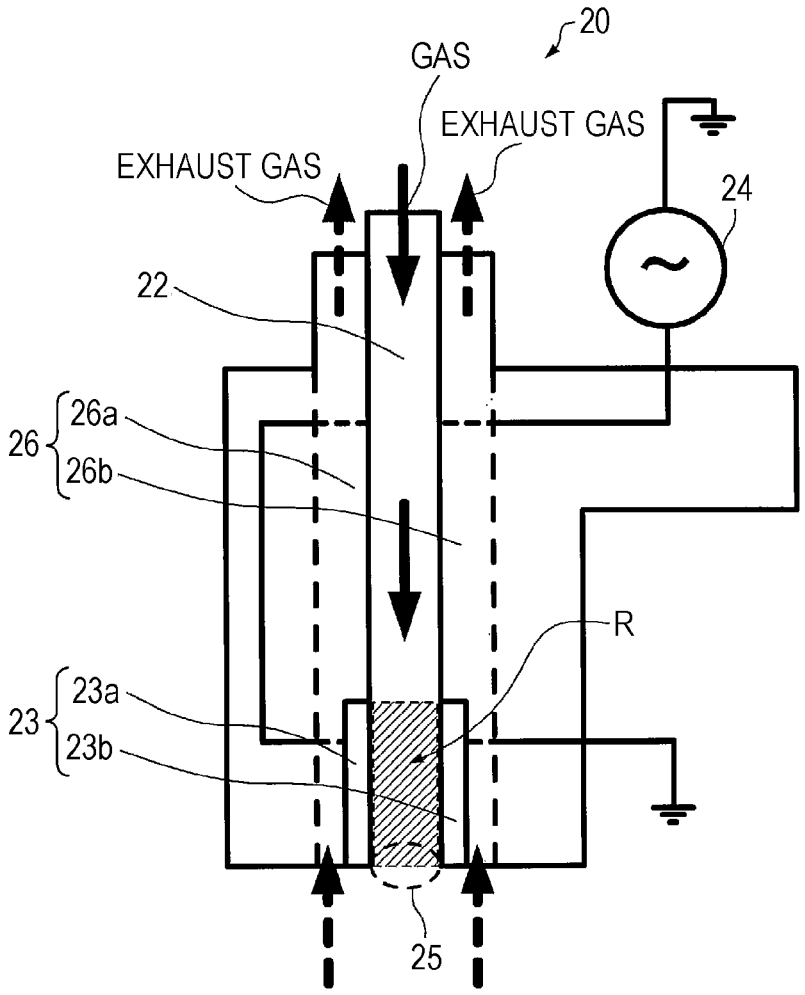
FIG. 4 is a diagram schematically illustrating a cross section of a plasma irradiation mechanism.

FIG. 4 is a diagram schematically illustrating a cross section of the plasma irradiation mechanism 20. The plasma irradiation mechanism 20 includes a gas supplying chamber 22 that is connected to a gas storage section (not illustrated), an electrode pair 23 that is provided to face at least a portion of the gas supplying chamber 22, a power supply 24, the plasma irradiation opening 25, and exhaust pipes 26.

The gas supplying chamber 22 is connected to a gas storage section 29 by a gas supply tube (not illustrated), so that the gas stored in the gas storage section 29 is in a flowable state. The electrode pair 23 is provided at an arbitrary position of the gas supplying chamber 22. The electrode pair 23 includes an electrode 23*a* and an electrode 23*b* installed so as to face each other. The power supply 24 is connected to the electrode 23*a* and the electrode 23*b* so that a voltage can be applied.

The plasma irradiation opening 25 is provided on the front edge of the gas supplying chamber 22 that faces the medium 2. The plasma irradiation opening 25 is a nozzle hole for applying plasma generated by gas passing through a portion between the electrode 23*a* and the electrode 23*b*. The area between the electrode 23*a* and the electrode 23*b* becomes an electricity discharge portion R (discharging area).

The exhaust pipes 26 are installed so as to adjust an irradiation scope of the plasma emitted from the plasma irradiation opening 25 by absorbing and exhausting excess gas and performing plasma irradiation so as to locally treat a desired scope. The installation positions of the exhaust pipes 26 are not particularly limited, but for example, in the example of FIG. 3, two exhaust pipes 26*a* and 26*b* are included and installed along the gas supplying chamber 22.

If voltage is applied to the electrodes 23*a* and 23*b* by the power supply 24, discharge occurs between the electrodes 23*a* and 23*b* ("the electricity discharge portion R"). In this manner, in a state in which the discharge occurs, the gas is supplied to the gas supplying chamber 22 and passes through the portion between the electrode 23*a* and the electrode 23*b* so that the plasma of the gas is generated (that is, at least a portion of the gas turns into plasma). The plasma generated in this manner is applied from the plasma irradiation openings 25 to the surface of the medium 2. That is, the plasma generated in electricity discharge portion R is applied to the surface of the medium 2 in a state in which the electricity discharge portion R is not in contact with the medium 2. In other words, since the medium 2 does not pass through the electricity discharge portion R, the medium 2 is not in direct contact with the electricity discharge portion R. Such a plasma generation mechanism is called a remote type as described above.

In this manner, if the remote type plasma irradiation mechanism in which the medium is not in contact with the electricity discharge portion is used, the discoloration of the medium can be suppressed. Therefore, the texture or the tone of the medium is maintained. Particularly, if a medium having high whiteness is used, the effect can be achieved further.

The plasma irradiation mechanism 20 preferably has a mechanism that generates and applies plasma under atmospheric pressure. If the plasma is generated under atmospheric pressure, there is an advantage in that since a pressure reducing mechanism does not have to be provided in the plasma irradiation mechanism, the device can be reduced in size so that the plasma irradiation step is performed in a line (that is, steps such as plasma irradiation step and ink ejection step can be continuously performed). Here, the pressure when the plasma is generated refers to the pressure in the gas supplying chamber 22 when the plasma is generated.

The electric energy when the plasma is generated is not particularly limited as long as the plasma can be generated from the supplied gas, but the electric energy can be, for example, in the range of 20 Wh to 200 Wh.

The frequency of the power supply 24 when the plasma is generated is not particularly limited as long as the plasma can be generated from the supplied gas, but the frequency may be, for example, in the range of 50 Hz to 30 MHz. In addition, the power supply 24 may be a direct current power supply. However, since the temperature of the direct current power supply increases more easily, the alternate current power supply is preferably used. In the alternate current power supply, the increase of the temperature can be prevented by switching the current to a current in a reverse direction before the temperature increases.

One kind of gas may be supplied to the gas supplying chamber 22, and a mixed gas obtained by mixing two or more kinds of gas may be supplied. Examples of the material of the gas include oxygen ($O_2$), nitrogen ($N_2$), air (at least including nitrogen ($N_2$) and oxygen ($O_2$)), vapor ($H_2O$), nitrous oxide ($N_2O$), ammonia ($NH_3$), argon (Ar), helium (He), and neon (Ne). In addition, the flow rate of the gas supplied to the gas supplying chamber 22 can be appropriately set according to the capacity of the gas supplying chamber 22, the kind of gas, the kind of medium, and print speed, but the flow rate is not particularly limited.

For example, if oxidizing gas is supplied to the gas supplying chamber 22, a hydroxy group can be applied to the surface of the medium 2 by the plasma resulting from the oxidizing gas. In addition, if the oxygen atom is included in the structure skeleton of the medium, the plasma resulting from the inert gas can cut the bonding of oxygen included in the medium 2, and thus the hydroxy group can be generated on the surface of the medium by using inert gas as the gas supplied to the gas supplying chamber 22.

Ink

The composition of the ink is not particularly limited, but additives (components) that are included or that can be included are described below.

The ink may include coloring materials. The coloring materials are selected from pigments and dyes.

Pigment

The light stability of the ink can be enhanced by using a pigment as a coloring material. As a pigment, any one of inorganic pigments and organic pigments can be used.

The inorganic pigment is not particularly limited, but examples thereof include carbon black, iron oxide, titanium oxide, and silicon oxide. The inorganic pigments may be used singly, or two or more types thereof may used in combination.

The organic pigment is not particularly limited, but the examples thereof include a quinacridone-based pigment, a quinacridonequinone-based pigment, a dioxazine-based pigment, a phthalocyanine-based pigment, an anthrapyrimidine-based pigment, an anthanthrone-based pigment, an indanthrone-based pigment, a flavanthrone-based pigment, a perylene-based pigment, a diketopyrrolopyrrole-based pigment, a perinone-based pigment, a quinophthalone-based pigment, an anthraquinone-based pigment, a thioindigo-based pigment, a benzimidazolone-based pigment, an isoindolinone-based pigment, an azomethine-based pigment, and an azo-based pigment. Specific examples of the organic pigment may include the followings.

The pigments used in the black ink are not particularly limited, but examples thereof include carbon black. The carbon black is not particularly limited, and examples thereof include furnace black, lamp black, acetylene black, and channel black (C. I. Pigment Black 7). In addition, commercially available products of the carbon black are not particularly limited, but examples thereof include No. 2300, 900, MCF88, No. 20B, No. 33, No. 40, No. 45, No. 52, MA7, MA8, MA100, and No. 2200B (above are all product names manufactured by Mitsubishi Chemical Corporation), Color black FW1, FW2, FW2V, FW18, FW200, S150, S160, and S170, Printex 35, U, V, 140U, Special black 6, 5, 4A, 4, and 250 (above are all product names manufactured by Degussa AG), Conductex SC, Raven 1255, 5750, 5250, 5000, 3500, 1255, and 700 (above are all product names manufactured by Columbian Carbon Japan, Ltd.), Regal 400R, 330R, and 660R, Mogul L, Monarch 700, 800, 880, 900, 1000, 1100, 1300, 1400, and Elftex 12 (above are all product names manufactured by Cabot Corporation).

Examples of the pigments used in a cyan ink include C. I. Pigment Blues 1, 2, 3, 15, 15:1, 15:2, 15:3, 15:4, 15:6, 15:34, 16, 18, 22, 60, 65, and 66, and C. I. Vat Blues 4 and 60. Among them, at least one of C. I. Pigment Blues 15:3 and 15:4 is preferable.

Examples of the pigment used in a magenta ink include C. I. Pigment Reds 1, 2, 3, 4, 5, 6, 7, 8, 9, 10, 11, 12, 14, 15, 16, 17, 18, 19, 21, 22, 23, 30, 31, 32, 37, 38, 40, 41, 42, 48:2, 48:4, 57, 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, and C. I. Pigment Violets 19, 23, 32, 33, 36, 38, 43, and 50. Among them, at least one selected from the group consisting of C. I. Pigment Red 122, C. I. Pigment Red 202, and C. I. Pigment Violet 19 is preferable.

Examples of the pigment used in a yellow ink include C. I. Pigment Yellows 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213. Among them, at least one selected from the group consisting of C. I. Pigment Yellows 74, 155, and 213 is preferable.

In addition, as the pigments used in respective inks other than the above colors such as green ink or orange ink, well-known pigments in the related art can be used.

Dye

Dyes may be used as a coloring material. The dyes are not particularly limited, and acid dyes, direct dyes, reactive dyes, and basic dyes can be used.

The content of the coloring material is preferably 0.4% by mass to 12% by mass, and more preferably 2% by mass to 5% by mass with respect to the total mass (100% by mass) of the ink.

Resin

The ink may contain resins. If the ink contains the resins, resin coating is formed on the medium and resultantly the ink is sufficiently fixed to the medium so as to make the friction resistance of the image satisfactory.

The resin may be any one of an anionic resin, a non-ionic resin, or a cationic resin. Among them, since the material is appropriate for the head, the non-ionic resin or the anionic resin is preferable.

The resins may be used singly, or two or more types thereof may be used in combination.

In addition, examples of the resins that may be contained in the ink include a resin dispersant, a resin emulsion, and wax.

Resin Dispersant

When the pigment is contained in the ink according to the first embodiment, the ink may contain the resin dispersant so that the pigment is stably dispersed and maintained in water. If the ink contains the pigment dispersed by using the resin dispersant such as the aqueous resin or the water dispersible resin (hereinafter referred to as "resin dispersion pigment"), when the ink is attached to the medium, at least one of the adhesiveness between the medium and the ink or the adhesiveness between solidified products in the ink can be caused to be satisfactory. Among the resin dispersants, since the aqueous resin has excellent dispersion stability, the aqueous resin is preferable.

The resin dispersants may be used singly, or two or more types thereof may be used in combination.

Among the resins, the addition amount of the resin dispersant to the pigment is preferably 1 part by mass to 100 parts by mass and more preferably 5 parts by mass to 50 parts by mass with respect to the 100 parts by mass of the pigment. If the addition amount is in the scope described above, the satisfactory dispersion stability of the pigment in water can be secured.

Resin Emulsion

The ink may contain the resin emulsion. The resin emulsion forms the resin coating to provide an effect of causing the ink to be sufficiently fixed to the medium so that the adhesiveness and the friction resistance of an image can be satisfactory.

In addition, the resin emulsion functioning as a binder is contained in an emulsion state in the ink. If the resin emulsion functioning as a binder is caused to be contained in the ink in an emulsion state, the viscosity of the ink can be easily adjusted to the scope appropriate for the ink jet recording method, and the preservation stability and the ejection stability of the ink become excellent.

The resin emulsions are not particularly limited, but the examples thereof include a homopolymer or a copolymer of (meth)acrylate, (meth)acrylic ester, acrylonitrile, cyanoacrylate, acrylamide, olefin, styrene, vinyl acetate, vinyl chloride, vinyl alcohol, vinyl ether, vinyl pyrrolidone, vinyl pyridine, vinyl carbazole, vinyl imidazole, and vinylidene chloride, a fluororesin, and a natural resin. Among them, at least any one of the (meth)acryl-based resin and a styrene-(meth)acrylate copolymer-based resin is preferable, at least one of the acryl-based resin and the styrene-acrylate copolymer-based resin is more preferable, and the styrene-acrylate copolymer-based resin is still more preferable. In addition, the copolymer may be at least one of a random copolymer, a block copolymer, an alternating copolymer, and a graft copolymer.

As the resin emulsion, a commercially available product may be used, or a product manufactured by an emulsion polymerization method as described below may be used. As a method of obtaining the thermoplastic resin in the ink in an emulsion state, a method of performing emulsion polymerization on the monomer of the aqueous resin described above in water in the existence of the polymerization catalyst and the emulsifier may be included. The polymerization initiator, the emulsifier, and the molecular weight regulator used in the emulsion polymerization can be used according to the well-known method in the related art.

The average particle diameter of the resin emulsion is preferable in the range of 5 nm to 400 nm, and more preferably in the range of 20 nm to 300 nm in order to cause the preservation stability and the ejection stability of the ink to become further satisfactory.

The average particle diameter in the specification is a volume-based average particle diameter, if not described otherwise. As the measurement method, the light intensity distribution pattern of the diffracted and scattered light is detected by using a laser diffraction particle size distribution measuring device and the light intensity distribution pattern is calculated based on the Mie scattering theory to obtain the volume-based particle size distribution. The volume average particle diameter can be calculated from the particle size distribution. An example of the laser diffraction particle size distribution measuring device may include Microtrac UPA (manufactured by Nikkiso Co., Ltd.).

The resin emulsions may be used singly, or two or more types thereof may be used in combination.

The content of the resin emulsion in the resin is preferably in the range of 0.5% by mass to 7% by mass with respect to the total mass (100% by mass) of the ink. If the content is in the range described above, the solid content concentration can be decreased so that the ejection stability can become further satisfactory.

Surfactant

The ink may contain the surfactant. The surfactant is not particularly limited, but examples thereof may include the acetylene glycol-based surfactant, a fluorine-based surfactant, and a silicone-based surfactant. If the ink contains the surfactants, the preservation stability and the ejection stability of the ink become more satisfactory and also high speed printing become possible.

The acetylene glycol-based surfactant is not particularly limited, but the acetylene glycol-based surfactant is preferably more than one selected from the group consisting of alkylene oxide adducts of 2,4,7,9-tetramethyl-5-decyne-4,7-diol and 2,4,7,9-tetramethyl-5-decyne-4,7-diol, and alkylene oxide adducts of 2,4-dimethyl-5-decyne-4-ol and 2,4-dimethyl-5-decyne-4-ol. Commercially available products of the acetylene glycol-based surfactant are not particularly limited, but examples thereof include Olfine 104 series, E series such as Olfine E1010 (product names manufactured by Air Products Japan, Inc.), and Sufynol 104, 465, and 61 (product names manufactured by Nissin Chemical Industry Co., Ltd.). The acetylene glycol-based surfactants may be used singly, or two or more types thereof may be used in combination.

The fluorine-based surfactant is not particularly limited, but the examples thereof include perfluoroalkyl sulfonic acid salt, perfluoroalkyl carboxylic acid salt, perfluoroalkyl phosphoric acid ester, perfluoroalkyl ethylene oxide adduct, perfluoroalkyl betaine, and a perfluoroalkyl amine oxide compound. Commercially available products of the fluorine-based surfactant are not particularly limited, but the examples thereof include S-144 and S-145 (manufactured by Asahi Glass Co., Ltd.); FC-170C, FC-430, and Fluorad-FC4430 (manufactured by Sumitomo 3M Ltd.); FSO, FSO-100, FSN, FSN-100, and FS-300 (manufactured by DuPont); and FT-250 and 251 (manufactured by Neos Company Limited). The fluorine-based surfactant may be used singly, or two or more types thereof may be used in combination.

As the silicone-based surfactant, a polysiloxane-based compound, a polyether-modified organosiloxane, and the like may be used. The commercially available products of the silicone-based surfactant are not particularly limited, but the specific examples thereof include BYK-306, BYK-307, BYK-333, BYK-341, BYK-345, BYK-346, BYK-347, BYK-348, and BYK-349 (above are product names manufactured by BYK Japan K.K.), and KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (above are product names manufactured by Shin-Etsu Chemical Co., Ltd.).

The surfactant may be used singly or two or more types thereof may be used in mixture.

The content of the surfactant is preferably in the range of 0.1% by mass to 3% by mass with respect to the total mass (100% by mass) of the ink since the preservation stability and the ejection stability of the ink become more satisfactory.

Water

The ink may contain water. Particularly, if the corresponding ink is aqueous ink, water is a main medium of the ink, and is the component that is evaporated and scattered when the medium is heated in the ink jet recording.

Examples of the water include pure water such as ion exchanged water, ultrafiltrated water, reverse osmosis water, and distilled water, and water from which ionic impurities are removed as much as possible such as ultrapure water. In addition, if water sterilized by the ultraviolet ray irradiation or the addition of hydrogen peroxide is used, when the pigment dispersing liquid and the ink using the pigment dispersing liquid are preserved for a long time, the generation of the fungus or the bacteria can be prevented.

The content of water is not particularly limited, and may be appropriately determined, if necessary.

Organic Solvent

The ink may contain the volatile water soluble organic solvent. The organic solvent is not particularly limited, but the examples thereof include alcohols or glycols such as glycerine, ethylene glycol, diethylene glycol, triethylene glycol, propylene glycol, dipropylene glycol, 1,3-propanediol, 1,2-butanediol, 1,2-pentanediol, 1,2-hexanediol, 1,4-butanediol, 1,5-pentanediol, 1,6-hexanediol, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-n-butyl ether, triethylene glycol mono-n-butyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-propyl ether, dipropylene glycol mono-iso-propyl ether, diethylene glycol dimethyl ether, diethylene glycol diethyl ether, diethylene glycol dibutyl ether, diethylene glycol ethylmethyl ether, diethylene glycol butyl methyl ether, triethylene glycol dimethyl ether, tetraethylene glycol dimethyl ether, dipropylene glycol dimethyl ether, dipropylene glycol diethyl ether, tripropylene glycol dimethyl ether, methanol, ethanol, n-propyl alcohol, iso-propyl alcohol, n-butanol, 2-butanol, tert-butanol, iso-butanol, n-penthanol, 2-penthanol, 3-penthanol, and tert-penthanol, N,N-dimethylformamide, N,N-dimethylacetoamide, 2-pyrrolidone, N-methyl-2-pyrrolidone, 2-oxazolidone, 1,3-dimethyl-2-imidazolidone, dimethyl sulfoxide, sulfolane, and 1,1,3,3-tetramethylurea.

The organic solvent may be used singly, or two or more types thereof may be used in combination. The content of the organic solvent is not particularly limited, and may be appropriately determined, if necessary.

pH Regulator

The ink may contain the pH regulator. Examples of the pH regulator include inorganic alkali such as sodium hydroxide and potassium hydroxide, ammonia, diethanolamine, triethanolamine, triisopropanolamine, morpholine, potassium dihydrogen phosphate, and disodium hydrogen phosphate.

The pH regulator may be used singly, or two or more types thereof may be used in combination. The content of the pH regulator is not particularly limited, and may be appropriately determined, if necessary.

Other Components

In addition to the components described above, various kinds of additives such as a dissolution aid, a viscosity modifier, an antioxidant, a preservative, an anti-fungal agent, an anti-foaming agent, and a corrosion inhibitor may be added to the ink. In addition, if the ink is the ultraviolet ray curable ink, the ink contains, for example, a polymerizable compound and a photo initiator.

Ink Preparation Method

The ink can be obtained by mixing the components (materials) described above in an arbitrary sequence, filtering the mixture, if necessary, and removing impurities. Here, it is preferable to mix the pigments after being prepared in a state of being evenly dispersed in the solvent in advance, since the handling becomes easy.

As a mixing method of the respective materials, a method of sequentially adding materials to a container including a stirring device such as a mechanical stirrer or a magnetic stirrer and stirring and mixing the materials is preferably used. As the filtration method, for example, the centrifugal filtration or the filter filtration may be used, if necessary.

Medium(s)

Examples of the medium (recording medium) include absorbable and non-absorbable medium. Particularly, the invention can be applied to medium in a wide range of absorption performance from non-absorbable medium to which the penetration of the ink is difficult to absorbable medium to which the penetration of the ink is easy.

The absorbable medium is not particularly limited, but the examples thereof is preferably highly absorbable medium such as cloth. The cloth is not limited to the below, but may include, for example, natural fibers and synthetic fibers such as silk, cotton, wool, nylon, polyester, and rayon.

The non-absorbable medium is not particularly limited, but the examples thereof include plastic films or plates such as polyvinyl chloride, polyethylene, polypropylene, polyethylene terephthalate (PET), metal plates such as iron, silver, copper, and aluminum, metal plates manufactured by depositing the various kinds of metal, plastic films, and alloy plates of stainless steel, brass, or the like. In addition, an ink absorbing layer including silica particles or alumina particles or an ink absorbing layer including the hydrophilic polymer such as polyvinyl alcohol (PVA) or polyvinylpyrrolidone (PVP) is not preferably formed in the non-absorbable medium.

Printing Method

Figure 5:
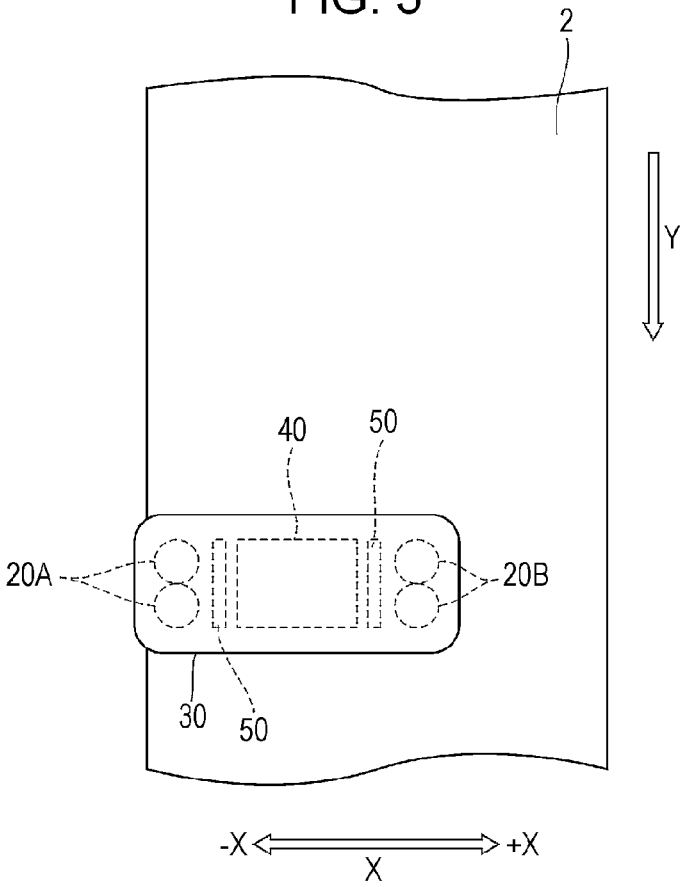
FIG. 5 is a diagram illustrating a printing method using the ink jet printer according to the first embodiment.

Subsequently, with reference to FIG. 5, the printing method using the ink jet printer 1 is described.

The printing method according to the first embodiment is a printing method that performs printing on the medium 2 transported in the Y direction by the transportation mechanism 10, and has a plasma irradiation step of irradiating a predetermined area of the medium 2 with plasma and an ink ejection step of ejecting ink from the head 40 to a portion of the medium 2 to which the plasma is irradiated.

Since the ink jet printer 1 is a serial type ink jet printer, the transportation of the medium 2 by the transportation mechanism 10 is intermittently performed. That is, in a state in which the medium 2 is stopped, the printing is performed on the predetermined range of the medium 2 by moving the carriage 30 in the X direction, and then the medium 2 is moved to a predetermined position in the Y direction by the transportation mechanism 10 and this operation is repeated. That is, the transportation step of the medium and the printing step (plasma irradiation step and ink ejection step) are repeatedly performed to perform printing on the medium 2.

Specifically, in the printing operation by the carriage 30, the medium 2 is irradiated with the plasma by the plasma irradiation mechanisms 20 while the carriage 30 moves in the X direction, and the ink is ejected by the head 40 to the portion of the medium which is irradiated with the plasma.

The surface of the medium 2 is reformed by irradiating the medium 2 with the plasma, so that the compatibility of the medium 2 with the ink can be enhanced. The compatibility of the medium 2 with the ink means hydrophilicity or water repellent properties of the medium 2. Particularly, in the plasma irradiation step, if the medium 2 is irradiated with the plasma while the electricity discharge portion is not in contact with the medium 2, the damage or the discoloration of the medium 2 can be suppressed.

According to the first embodiment, the same portion of the medium 2 is preferably irradiated with the plasma at least twice before the ink is attached to the medium 2. Since the effect of the surface modification of the medium may not be sufficient by one time of the irradiation. If the irradiation is performed twice, the effect of the surface modification can be more securely obtained. Specifically, dirt on the surface of the medium is removed in a first irradiation, and the surface of the medium 2 is reformed by giving a functional group derived from the types of the gas or cleaving the bond of the surface of the medium in a second irradiation.

If the plasma irradiation is performed two or more times before the attachment of the ink, the plasma irradiation is performed by the plasma irradiation mechanisms 20 in a first reciprocating operation of the carriage 30, and the ink may be ejected from the head 40 while the plasma irradiation is performed by the plasma irradiation mechanism in a second reciprocating operation, if necessary. One or both of the plasma irradiation mechanisms 20 (20A and 20B) provided on both sides of the head 40 may be operated. For example, if both of the plasma irradiation mechanisms 20A and 20B are operated in the first reciprocating operation, two times of plasma irradiation may be performed in the first reciprocating operation. In addition, if only the plasma irradiation mechanism on one side is operated in the first reciprocating operation, the plasma irradiation mechanisms 20 on the forward side of the head 40 in the movement direction may be operated in the second reciprocating operation. Specifically, if the ink is ejected while the carriage moves in the +X direction, the plasma irradiation mechanisms 20B on the +X direction side may be operated in the second reciprocating operation. In addition, if the ink is ejected while the carriage moves in the −X direction, the plasma irradiation mechanisms 20B on the −X direction side are operated in the second reciprocating operation. In addition, the carriage 30 may be a type of performing unidirectional printing in which the ink is ejected when the carriage 30 moves only in the +X direction or in the −X direction, or may be a type of performing bi-directional printing in which the ink is ejected when the carriage 30 moves in the +X direction and the −X direction.

After the plasma irradiation and ink ejection in the predetermined range of the medium 2 end, the medium 2 is transported only in the predetermined distance by the transportation mechanism 10 and the plasma irradiation and ink ejection on an area adjacent to the predetermined range are performed again.

After the ink ejection, the solvent contained in the ink is dried by the drying mechanism, if necessary. In addition, if the ink is the ultraviolet ray curable ink, ultraviolet ray irradiation is performed after the ejection of the ink.

By the plasma irradiation step, if a functional group such as a hydroxy group generated in the predetermined area of the medium is left for a certain period of time, a portion thereof may be detached or the like to disappear. According to the first embodiment, since the plasma irradiation mechanisms 20 are provided on the head 40 on both sides in the movement direction of the head 40, the time from the irradiation of the plasma to the ejection of the ink can be reduced. Accordingly, while the effect of the surface modification of the medium by the plasma is maintained, the ink can be ejected so that the print quality can be enhanced.

Second Embodiment

While the plasma irradiation mechanisms 20 are provided on both sides of the head 40 in the first embodiment, the plasma irradiation mechanisms 20 are provided only on one side of the head 40 in a second embodiment. Hereinafter, the ink jet printer and the printing method according to the second embodiment are described focusing on the difference from the first embodiment. The points which are not particularly described are the same as in the first embodiment. In addition, in FIGS. 6 and 7, the configurations which are the same as the first embodiment are denoted by the reference numerals same as the reference numerals used in FIGS. 1 to 5.

Ink Jet Printer

Figure 6:
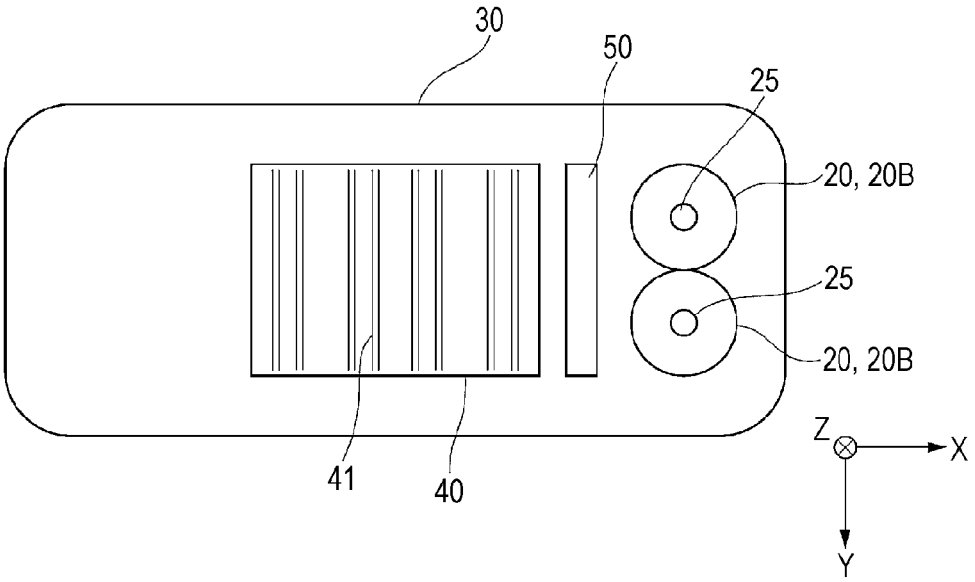
FIG. 6 is a bottom view schematically illustrating a configuration of a carriage of an ink jet printer according to a second embodiment.

FIG. 6 is a bottom view schematically illustrating a configuration of the carriage 30 of the ink jet printer 1 according to the second embodiment. As illustrated in FIG. 6, the plasma irradiation mechanisms 20 (20B) are provided on one side of the head 40 in the X direction. In the example illustrated in FIG. 6, the plasma irradiation mechanisms 20B are the spot-type plasma irradiation mechanisms.

Printing Method

Figure 7:
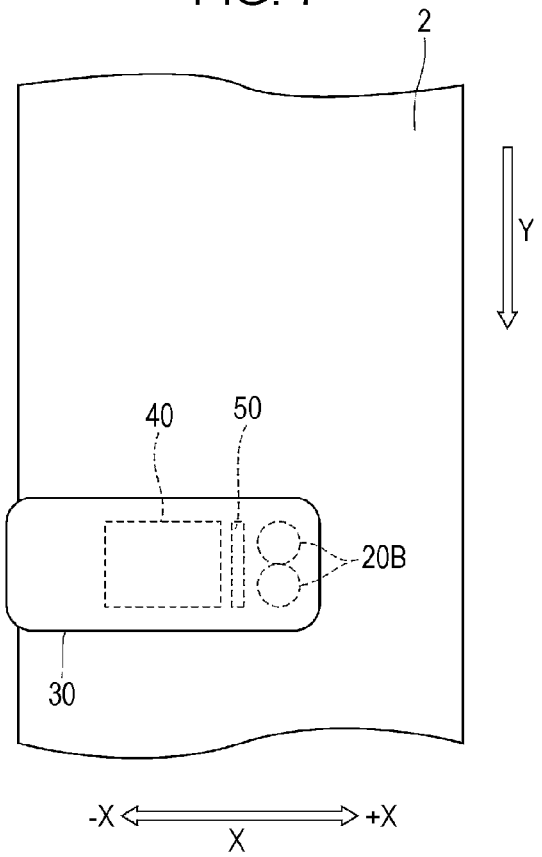
FIG. 7 is a diagram illustrating a printing method using the ink jet printer according to the second embodiment.

Subsequently, the printing method using the ink jet printer 1 is described with reference to FIG. 7.

The second embodiment is particularly effective if the carriage 30 is a type of performing unidirectional printing in which the ink is ejected only when the carriage moves in the +X direction. That is, if the plasma irradiation is performed twice or more before the attachment of the ink, for example, when the carriage 30 moves in the −X direction, the plasma irradiation is performed by the plasma irradiation mechanisms 20B, and when the carriage 30 moves in the +X direction, the ink is ejected from the head 40 while the plasma irradiation is performed by the plasma irradiation mechanisms 20B.

In this manner, when the carriage 30 is a type of performing unidirectional printing in which the ink is ejected only when the carriage 30 moves in the +X direction, even if the plasma irradiation mechanism is provided only on one side of the head 40, the effect which is the same as in the first embodiment can be achieved.

In addition, if the carriage 30 is a type of performing unidirectional printing in which the ink is ejected only when the carriage 30 moves in the −X direction, the plasma irradiation mechanism may be provided on the −X direction side of the head 40.

Third Embodiment

While the spot-type plasma irradiation mechanism is employed as the plasma irradiation mechanism in the first and second embodiments, the line-type plasma irradiation mechanism is employed in the third embodiment. Hereinafter, the ink jet printer and the printing method according to the third embodiment are described focusing on the difference from the first embodiment. The points which are not particularly described are the same as in the first embodiment. In addition, in FIG. 8, the configurations which are the same as the first embodiment are denoted by the reference numerals same as the reference numerals used in FIGS. 1 to 5.

Figure 8:
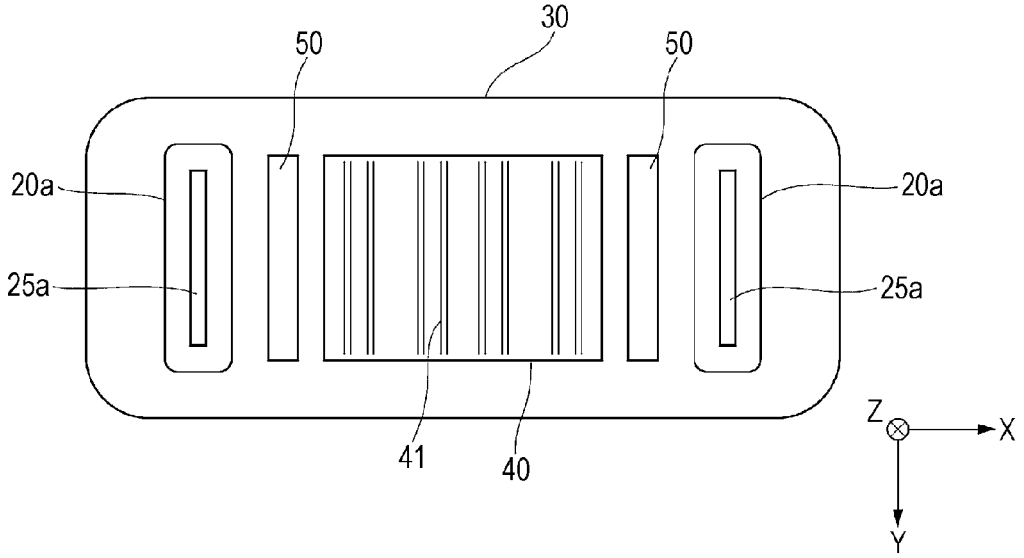
FIG. 8 is a bottom view schematically illustrating a configuration of a carriage of an ink jet printer according to a third embodiment.

FIG. 8 is a bottom view schematically illustrating a configuration of the carriage 30 of the ink jet printer according to the third embodiment. As illustrated in FIG. 8, the line-type plasma irradiation mechanisms 20*a* are disposed on both sides of the head 40 in a line. The plasma irradiation openings 25*a* of the plasma irradiation mechanisms 20*a* are line types in which the transportation direction (Y) of the medium 2 is the longitudinal direction.

The line-type plasma irradiation mechanisms 20*a* have an advantage in that the plasma irradiation can be evenly performed compared with the spot-type plasma irradiation mechanism.

Fourth Embodiment

While the line-type plasma irradiation mechanisms 20*a* are provided on both sides of the head 40 in the third embodiment, the line-type plasma irradiation mechanism 20*a* is provided on only one side of the head 40 in the fourth embodiment. Hereinafter, the ink jet printer and the printing method according to the fourth embodiment are described focusing on the difference from the third embodiment. The points which are not particularly described are the same as in the first and third embodiments. In addition, in FIG. 9, the configurations which are the same as the first embodiment are denoted by the reference numerals same as the reference numerals used in FIGS. 1 to 5 and FIG. 8.

Figure 9:
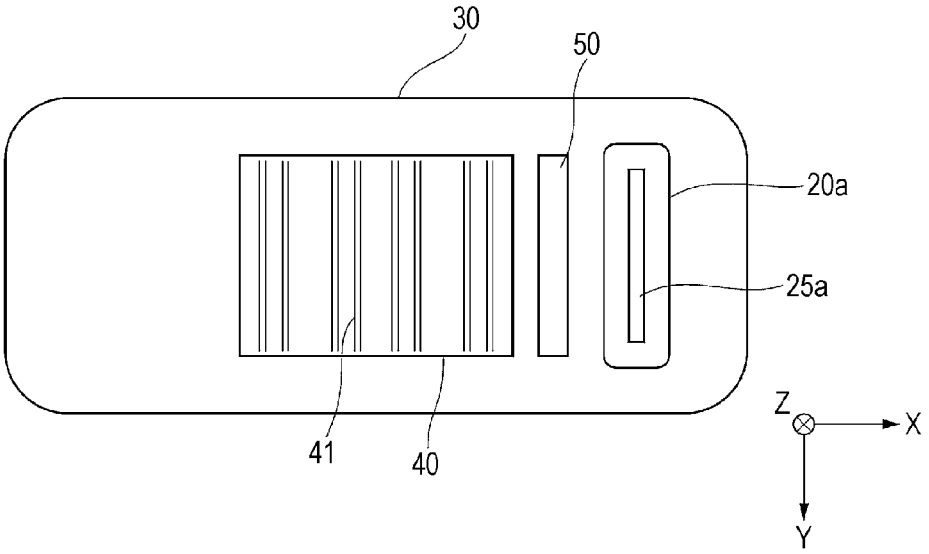
FIG. 9 is a bottom view schematically illustrating a configuration of a carriage of an ink jet printer according to a fourth embodiment.

FIG. 9 is a bottom view schematically illustrating a configuration of the carriage 30 of the ink jet printer according to the fourth embodiment. As illustrated in FIG. 9, the line-type plasma irradiation mechanism 20*a* is provided on one side of the head 40 in the X direction.

As also described in the second embodiment, if the carriage 30 is a type of performing unidirectional printing in which the ink is ejected only when the carriage 30 moves in the +X direction, the effect which is the same as in the third embodiment can be achieved by providing the plasma irradiation mechanism 20*a* only on the +X direction side of the head 40.

In addition, if the carriage 30 is a type of performing unidirectional printing in which the ink is ejected only when the carriage 30 moves in the −X direction, the plasma irradiation mechanism 20*a* may be provided only on the −X direction side of the head 40.

EXAMPLES

Hereinafter, the invention is described in detail with reference to examples, but the invention is not limited to the examples.

In the examples, the ink jet printer according to the first or the third embodiment in which the plasma irradiation mechanisms 20 are disposed on both sides of the head 40 is used. Specifically, a portion of PX-H10000 (manufactured by Seiko Epson Corp.) is reformed to mount a spot-type or a line-type plasma irradiation mechanism on the carriage. In addition, in the example, partition boards having four kinds of shapes are used.

With reference to FIGS. 10 to 13, the shapes of the partition boards used in the examples are described.

Figure 10:
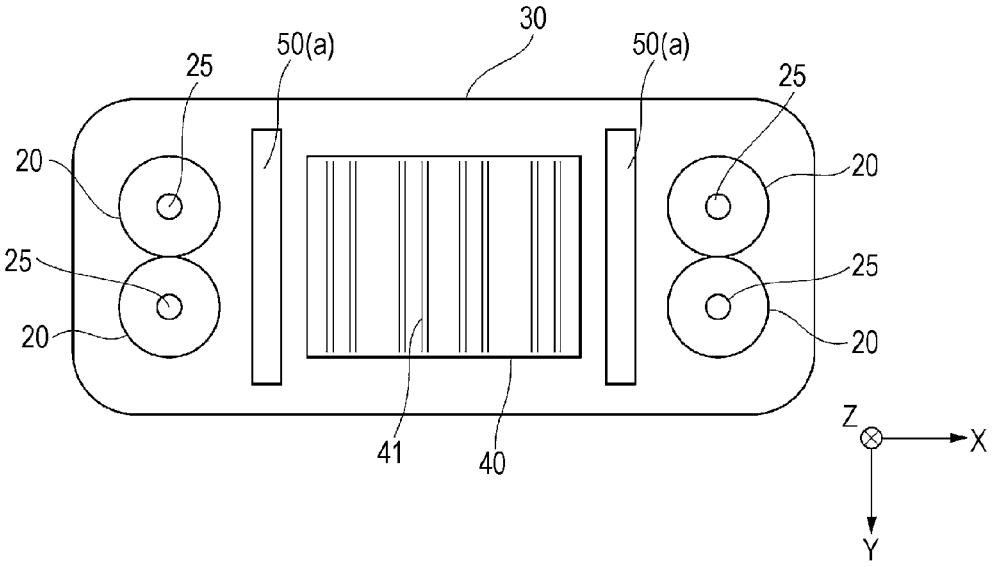
FIG. 10 is a bottom view schematically illustrating an example of a configuration of a carriage of an ink jet printer in an example.

Partition boards 50(*a*) illustrated in FIG. 10 are examples in which the length of the partition board in the first direction (Y) is longer than that of the head 40 in the first direction, and the partition boards 50(*a*) are disposed to correspond to the plasma irradiation openings 25 of the plasma irradiation mechanisms 20. The expression "being disposed to correspond to the plasma irradiation openings 25" means being disposed to be adjacent to the plasma irradiation openings 25 in the X direction. In the example illustrated in FIG. 10, the partition boards 50(*a*) are disposed to block all plural virtual lines that connect the respective plasma irradiation openings 25 to all the nozzles 41.

Figure 11:
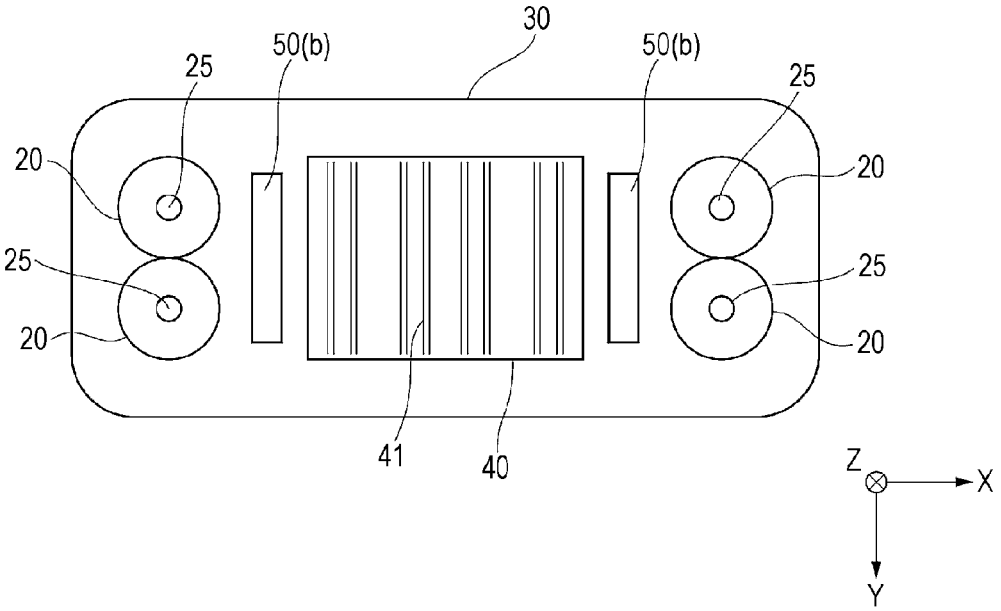
FIG. 11 is a bottom view schematically illustrating another example of a configuration of the carriage of the ink jet printer in the example.

Partition boards 50(*b*) illustrated in FIG. 11 are examples in which the length of the partition board in the first direction (Y) is shorter than that of the head 40 in the first direction, and the partition boards 50(*b*) are disposed to correspond to the plasma irradiation openings 25 of the plasma irradiation mechanisms 20. Also in the example illustrated in FIG. 11, the partition boards 50(*b*) are disposed to block all plural virtual lines that connect the respective plasma irradiation openings 25 to all the nozzles 41.

Figure 12:
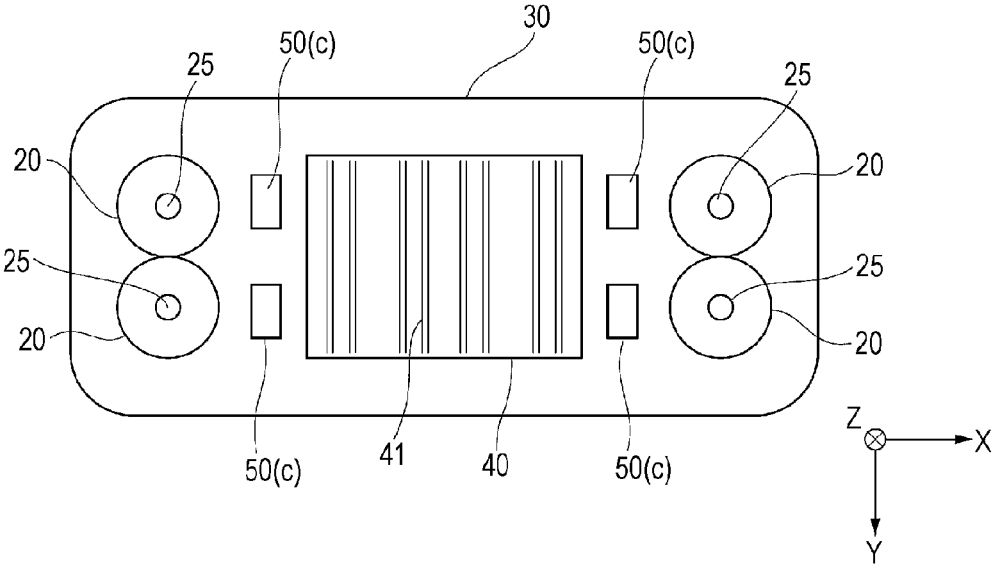
FIG. 12 is a bottom view schematically illustrating another example of a configuration of the carriage of the ink jet printer in the example.

Partition boards 50(*c*) illustrated in FIG. 12 may be disposed in a divided manner, and the respective portions of the partition boards are disposed to correspond to the plural plasma irradiation openings 25, respectively. In other words, the respective portions of the partition board are disposed to be adjacent to the plural plasma irradiation openings 25 in the X direction. In the examples illustrated in FIG. 12, the partition boards 50(*c*) are disposed to block all the plural virtual lines that connect the respective plasma irradiation openings 25 to the nozzles 41 closest to the respective plasma irradiation openings 25.

Figure 13:
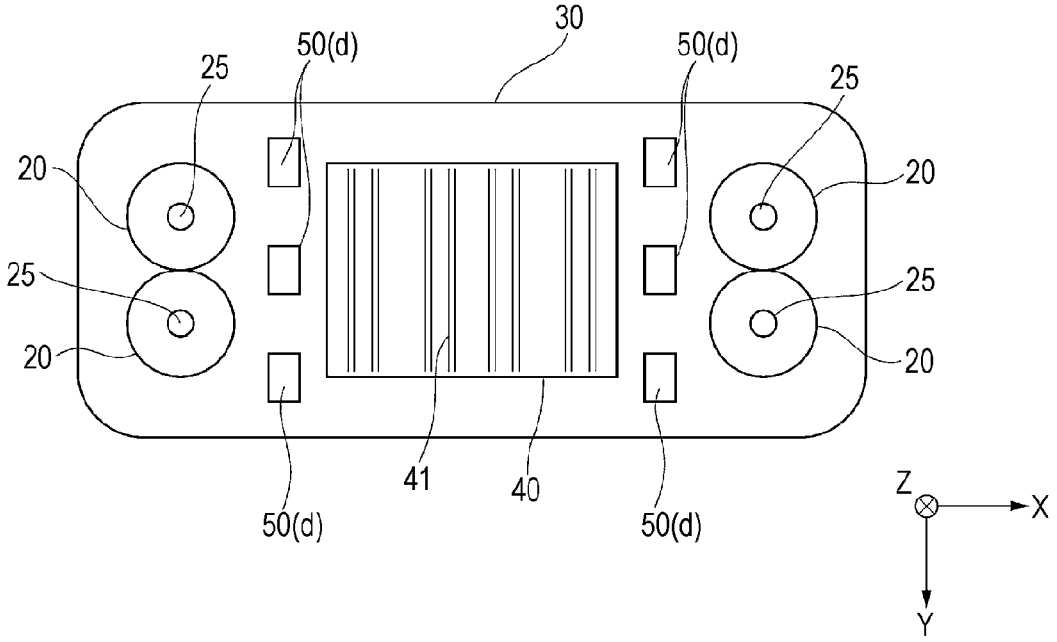
FIG. 13 is a bottom view schematically illustrating another example of a configuration of the carriage of the ink jet printer in the example.

Partition boards 50(*d*) illustrated in FIG. 13 are disposed in a divided manner, but the respective portions of the partition board are not disposed to respectively correspond to the plural plasma irradiation openings 25. That is, the respective portions of the partition board are not disposed to be adjacent to the plural plasma irradiation openings 25 in the X direction. Therefore, in the example illustrated in FIG. 12, the partition boards 50(*d*) are not disposed to block the plural virtual lines that connect the respective plasma irradiation openings 25 to the nozzles 41 closest to the respective plasma irradiation openings 25.

The print conditions such as the shapes of the partition boards (a) to (d), the distance (A) to (E), the types of the gas, and the flow rates of the gas are changed to perform printing, and the ink jet printer was evaluated in various types of view points as described below. As the types of the gas, nitrogen ($N_2$) and oxygen ($O_2$) were used. The conditions of the printing and evaluation results are presented in Tables 1 to 3.

TABLE 1

| | Example 1 | Example 2 | Example 3 | Example 4 | Example 5 | Example 6 | Example 7 | Comparative Example 1 | Example 8 | Example 9 | Example 10 |
|---|---|---|---|---|---|---|---|---|---|---|---|
| Type of plasma irradiation section | Spot | Spot | Spot | Spot | Spot | Spot | Spot | Spot | Spot | Spot | Spot |

TABLE 1-continued

| | | Example 1 | Example 2 | Example 3 | Example 4 | Example 5 | Example 6 | Example 7 | Comparative Example 1 | Example 8 | Example 9 | Example 10 |
|---|---|---|---|---|---|---|---|---|---|---|---|---|
| Shape of partition board | | 50(a) | 50(a) | 50(a) | 50(a) | 50(a) | 50(a) | 50(a) | 50(a) | 50(a) | 50(a) | 50(a) |
| Various lengths | 50 (a) mm | 3 | 8 | 2 | 1 | 2.5 | 4.5 | 6.5 | 5 | 3 | 0.5 | 7.5 |
| | (B) mm | 4 | 8 | 7.5 | 3 | 4 | 7 | 10 | 3 | 12 | 2 | 11 |
| | (C) mm | | 2 | 4.5 | 1 | 0.5 | 2 | 4 | 6 | 2 | 2 | 6.5 |
| | (D) mm | 20 | 20 | 20 | 20 | 20 | 20 | 20 | 20 | 20 | 220 | 20 |
| | (E) mm | 50 | 50 | 50 | 50 | 50 | 50 | 50 | 50 | 50 | 50 | 50 |
| Type of gas | Flow rate L/min | 40 | 40 | 40 | 40 | 40 | 40 | 40 | 40 | 40 | 40 | 40 |
| | N2% | 97 | 97 | 97 | 97 | 97 | 97 | 97 | 97 | 97 | 97 | 97 |
| | O2% | 3 | 3 | 3 | 3 | 3 | 3 | 3 | 3 | 3 | 3 | 3 |
| Filling | | A | B | B | A | A | A | B | A | C | A | C |
| Wind ripple unevenness | | A | A | A | A | A | A | A | D | A | A | A |
| Nozzle attack properties | | A | A | A | A | A | A | A | D | A | A | A |
| Size of apparatus | | Small | Small | Small | Small | Small | Small | Small | Small | Small | Small | Small |
| Rubbing of coated surface | | A | A | A | B | A | A | A | A | A | C | A |

TABLE 2

| | | Example 11 | Example 12 | Example 13 | Example 14 | Example 15 | Example 16 | Example 17 | Example 18 | Example 19 | Example 20 | Example 21 | Example 22 |
|---|---|---|---|---|---|---|---|---|---|---|---|---|---|
| Type of plasma irradiation section | | Spot | Spot | Spot | Spot | Spot | Spot | Spot | Spot | Spot | Spot | Spot | Spot |
| Shape of partition board | | 50(a) | 50(a) | 50(a) | 50(a) | 50(a) | 50(a) | 50(a) | 50(a) | 50(a) | 50(a) | 50(a) | 50(a) |
| Various lengths | 50 (a) mm | 3 | 3 | 3 | 3 | 3 | 3 | 3 | 3 | 3 | 3 | 3 | 3 |
| | (B) mm | 4 | 4 | 4 | 4 | 4 | 4 | 4 | 4 | 4 | 4 | 4 | 4 |
| | (C) mm | 2 | 2 | 2 | 2 | 2 | 2 | 2 | 2 | 2 | 2 | 2 | 2 |
| | (D) mm | 50 | 75 | 5 | 7.5 | 15 | 25 | 30 | 250 | 480 | 2.5 | 2.5 | 530 |
| | (E) mm | 75 | 100 | 20 | 30 | 40 | 100 | 200 | 300 | 500 | 50 | 15 | 550 |
| Type of gas | Flow rate L/min | 40 | 40 | 40 | 40 | 40 | 40 | 40 | 40 | 40 | 40 | 40 | 40 |
| | N2% | 97 | 97 | 97 | 97 | 97 | 97 | 97 | 97 | 97 | 97 | 97 | 97 |
| | O2% | 3 | 3 | 3 | 3 | 3 | 3 | 3 | 3 | 3 | 3 | 3 | 3 |
| Filling | | A | A | B | A | A | A | A | A | A | C | C | A |
| Wind ripple unevenness | | A | A | B | B | A | A | A | A | A | A | C | A |
| Nozzle attack properties | | A | A | B | B | A | A | A | A | A | A | C | A |
| Size of apparatus | | Small | Small | Small | Small | Small | Small | Middle | Middle | Middle | Small | Small | Large |
| Rubbing of coated surface | | A | A | A | A | A | A | A | A | A | A | A | A |

TABLE 3

| | | Example 23 | Example 24 | Example 25 | Example 26 | Example 27 | Comparative Example 2 | Example 28 | Example 29 | Example 30 | Comparative Example 3 |
|---|---|---|---|---|---|---|---|---|---|---|---|
| Type of plasma irradiation section | | Spot | Spot | Line | Spot | Spot | Spot | Spot | Spot | Spot | Spot |
| Shape of partition board | | 50(a) | 50(a) | 50(a) | 50(a) | 50(a) | 50(a) | 50(b) | 50(c) | 50(d) | No partition board |
| Various lengths | 50 (a) mm | 3 | 3 | 3 | 3 | 3 | 3 | 3 | 3 | 3 | 3 |
| | (B) mm | 4 | 4 | 4 | 4 | 4 | 4 | 4 | 4 | 4 | 4 |
| | (C) mm | 2 | 2 | 2 | 2 | 2 | 2 | 2 | 2 | 2 | |
| | (D) mm | 20 | 20 | 20 | 20 | 20 | 20 | 20 | 20 | 20 | 20 |
| | (E) mm | 50 | 50 | 50 | 50 | 50 | 50 | 50 | 50 | 50 | 50 |
| Type of gas | Flow rate L/min | 20 | 60 | 60 | 40 | 40 | 40 | 40 | 40 | 40 | 40 |
| | N2% | 97 | 97 | 97 | 80 | 100 | NULL | 97 | 97 | 97 | 97 |
| | O2% | 3 | 3 | 3 | 20 | 0 | NULL | 3 | 3 | 3 | 3 |

TABLE 3-continued

| | Example 23 | Example 24 | Example 25 | Example 26 | Example 27 | Comparative Example 2 | Example 28 | Example 29 | Example 30 | Comparative Example 3 |
|---|---|---|---|---|---|---|---|---|---|---|
| Filling | B | B | A | B | B | D | A | A | A | A |
| Wind ripple unevenness | A | B | B | A | A | A | B | B | C | D |
| Nozzle attack properties | A | A | B | A | A | A | B | B | C | D |
| Size of apparatus | Small | Small | Small | Small | Small | Small | Small | Small | Small | Small |
| Rubbing of coated surface | A | A | A | A | A | A | A | A | A | A |

Table 1 presents results in which printing was performed by changing the distances (A) to (C), Table 2 presents results in which printing was performed by changing the distances (D) and (E), and Table 3 presents results in which printing was performed by changing the types of the gas and the flow rates thereof.

In all examples except for Example 27 and Comparative Examples 1 and 3, mixed gas in which plural kinds of gas were mixed was used. The types of the gas were mixed in a ratio presented in the respective examples, and then were sent to the gas supplying chamber 22 of the plasma irradiation mechanism 20. For example, in Example 1, after nitrogen and oxygen are mixed in the ratio of 97:3, and then the gas was supplied in the flow rate of 20 L/min. If the flow rate of the gas at this point is converted to the flow rates of the types of the gas, the flow rate of nitrogen becomes (20×0.97) L/min, and the flow rate of oxygen becomes (20×0.03) L/min.

In addition, in Comparative Example 2, the value of nitrogen and oxygen "NULL" indicates that plasma irradiation was not performed. Specifically, in Comparative Example 2, the gas in which nitrogen and oxygen were mixed in the ratio of 97:3 was supplied to the plasma irradiation mechanism 20 at the flow rate of 40 L/min, but the voltage was not applied to the electrode pair 23 and the plasma was not generated.

The medium, the images, and the apparatus (ink jet printer) after the printing were evaluated as follows.

Filling

When the duty 80% printing section was observed by a microscope (200 magnifications), filling of the ink was determined by the ratio in which the base was seen. The evaluation criteria were as follows. The evaluation results were presented in Tables 1 to 3.

A: Base was not seen at all by ink

B: Portion of base which was not covered with ink and exposed was less than 10%

C: Portion of base which was not covered with ink and exposed was in the range of 10% to less than 20%

D: Portion of base which was not covered with ink and exposed was 20% or greater From the result of the filling presented in Table 1, it was found that as the distance (B) between the plasma irradiation openings 25 and the surface of the medium 2 was greater, the plasma was deactivated and the filling became worse. In addition, from result of the filling presented in Table 2, it was found that as the shortest distance (D) between the nozzles 41 and the partition boards 50 was shorter, the ejected ink droplets were excessively close to the partition boards 50 and thus the ink droplets were influenced by the static electricity or the like, and attached to the partition boards 50, not to the paper surface, so that the filling became worse.

Wind Ripple Unevenness

Patterns of low duty sections (sections with duty of 30%) in which wind ripples easily occur were visually observed. Specifically, printing was performed on the A4 surface with the duty of 30%, and evaluation was performed in the wind ripple unevenness generation state. The wind ripple unevenness means a phenomenon in which the ink droplets were influenced by a convection current caused by gas required in the plasma irradiation and thus the unevenness was generated. The evaluation criteria were as follows. The evaluation results were presented in Tables 1 to 3.

A: Landing deviation did not occur on entire printed matter and wind ripple unevenness was not generated B: Landing deviation occurred in portion of printed matter with duty of 80% or higher and there is portion in which wind ripple unevenness occurs C: Landing deviation occurred in portion of printed matter with duty of 60% or higher and there is portion in which wind ripple unevenness occurs D: Landing deviation occurred in entire portion regardless of duty of printed matter and wind ripple unevenness occurs From the result of wind ripple unevenness presented in Table 1, it was found that if the distance (C) from the surface of the medium 2 to the bottom edge of the partition boards 50 was excessively long, the gas was not effectively blocked by the partition boards 50, the convection current caused by gas bent the ejected ink droplet, and as a result the wind ripple unevenness occurred. In addition, from the results of the wind ripple unevenness presented in Table 2, it was found that when the shortest distance (E) between the nozzles 41 and the plasma irradiation openings 25 was excessively short, the wind ripple unevenness was generated in the same manner.

Nozzle Attack Properties

It is assumed that if the head surface (nozzle plate surface) is attacked by the plasma irradiation, the water repellent film formed on the nozzle plate disappears. This is called the nozzle attack properties. If the ink repellent properties of the nozzle plate become weak, the nozzle plate is easily wet due to the ink. In this manner, the attached ink is dried and stuck to the nozzle plate, and flight curves occur. In order to evaluate the nozzle attack properties, continuous printing according to parameters in the tables was performed for 5 hours, the nozzle plates were taken out, and the attachment of the ink and the repelling state of the ink were observed. The evaluation criteria were as follows. The evaluation results are presented in Tables 1 to 3.

A: Ink repellent properties of nozzle plate were not changed (compared with those before printing, change of contact angle of aqueous ink is less than 5°)

B: Ink repellent properties of nozzle plate were slightly decreased (compared with those before printing, decrease of contact angle of aqueous ink was in the range of 5° to less than 10°)

C: Ink repellent properties of nozzle plate were decreased (compared with those before printing, decrease of contact angle of aqueous ink was in the range of 10° to less than 15°)

D: Ink repellent properties of nozzle plate were greatly decreased (compared with those before printing, decrease of contact angle of aqueous ink was 15° or greater)

From the result of the evaluation illustrated in Tables 1 to 3, the evaluations of the nozzle attack properties were linked to the evaluations of the wind ripple unevenness. This is because the nozzle attack properties and the wind ripple unevenness occur for basically the same reason. That is, the reason is the plasma that crosses over the partition board. However, as in Example 24 presented in Table 3, when the flow rate of the gas was greater than the optimum value, the influence of the convection current by the gas may be great, but the generation rate of the plasma may be small. In this case, the wind ripple unevenness easily occurs, but the nozzle attack properties decrease, so two evaluations may be slightly different from each other.

Rubbing of Coated Surface

If the ink droplet is attached to the medium and the medium is swollen, members (nozzle, partition board, front edge of plasma irradiation mechanism) of the ink jet printer disposed close to the medium come into contact with the medium so that the medium is scratched. The rubbing of the coated surface is to evaluate the damage of the medium. Specifically, Mactac 5829R was used as the medium, continuous printing was performed for 5 hours according to parameters in the tables of the examples, and the evaluation was performed by the evaluation criteria as follows. The evaluation results are presented in Tables 1 to 3.

A: Rubbing of coated surface did not occur, and paper jam did not occur

B: Rubbing of coated surface rarely occurs, and paper jam rarely occurs

C: Rubbing of coated surface sometimes occurs, and paper jam sometimes occurs

From the results of examples and comparative examples presented in Tables 1 to 3, the following was found out.

If Examples 1 to 10 and Comparative Example 1 presented in Table 1 are compared, when a distance from the surface of the medium 2 to the nozzles 41 was (A), a distance from the surface of the medium 2 to the plasma irradiation openings 25 was (B), and a distance from the surface of the medium 2 to the bottom edge of the partition boards 50 was (C), it was found that if the conditional expression of (C)<(A)≤(B) was satisfied, the wind ripple unevenness and the nozzle attack properties were enhanced.

From the results presented in Table 1, it was found that it was preferable to satisfy 0.5 mm≤(C)<(A)≤(B)≤10 mm. If the distance (C) was shorter than 0.5 mm, the partition boards 50 came into contact with the ink coated surface on the medium 2 so that the image was scratched or the paper jam occurred in some cases (see Example 9). In addition, if the distance (B) is greater than 10 mm, the effect of the surface modification by the plasma becomes low so that the filling of the ink was slightly decreased (see Examples 8 and 10).

From the results presented in Table 1, in view of the filling and the rubbing of the coated surface, it was found that the distance (A) from the surface of the medium 2 to the nozzles 41 was preferably in the range of 1.0 mm to 8.0 mm, and more preferably in the range of 2.5 mm to 4.5 mm.

From the same point of view, it was found that the distance (B) from the surface of the medium 2 to the plasma irradiation openings 25 was preferably in the range of 3.0 mm to 10.0 mm, and more preferably in the range of 4.0 mm to 7.0 mm.

From the same point of view, it was found that the distance (C) from the surface of the medium 2 to the bottom edge of the partition boards 50 was preferably in the range of 0.5 mm to 6.0 mm, and more preferably in the range of 2.0 mm to 4.0 mm.

From the results presented in Table 2, when the shortest distance between the nozzles 41 and the partition boards 50 was (D) and the shortest distance between the nozzles 41 and the plasma irradiation openings 25 was (E), it was found that the distances (D) and (E) preferably satisfy 5 mm≤(D)<(E)≤500 mm. If the distance (D) was shorter than 5 mm, the ink was blocked by the partition boards 50 and did not reach the medium 2 so that the filling of the ink was decreased (see Examples 20 and 21). In addition, if the distance (E) was shorter than 20 mm, the nozzles 41 and the plasma irradiation openings 25 became close to each other so that the wind ripple unevenness was easily generated and the nozzle was easily attacked (see Example 21). In addition, if the distance (E) is greater than 500 mm, the apparatus become large (see Example 22).

With reference to Examples 11 to 19 presented in Table 2, in view of the filling, on the condition that the shortest distance (D) between the nozzles 41 and the partition boards 50 was shorter than the shortest distance (E) between the nozzles 41 and the plasma irradiation openings 25, it was found that the shortest distance (D) was preferably 5 mm or longer, and more preferably 7.5 mm or longer. In addition, in view of nozzle attack properties, wind ripple unevenness, and the size of the apparatus, it was found that the shortest distance (E) between the nozzles 41 and the plasma irradiation openings 25 was preferably in the range of 20 mm to 500 mm, and more preferably in the range of 40 mm to 100 mm.

If Example 1 presented in Table 1, Examples 28 to presented in Table 3 were compared, and Comparative Example 3 presented in Table 3 were compared, it was found that the wind ripple unevenness and the nozzle attack properties were decreased by providing partition boards. In addition, with reference to Example 1 presented in Table 1 and Examples 28 to 30 presented in Table 3, in view of the decrease of the wind ripple unevenness and the nozzle attack properties, it was found that the shape of the partition board was most preferably the partition boards 50(*a*) illustrated in FIG. 10, and second preferably the partition boards 50(*b*) and 50(*c*) illustrated in FIGS. 11 and 12. If Example 1 presented in Table 1, Examples 28 to 30 presented in Table 3, and Comparative Example 3 presented in Table 3 were compared, it was found that the wind ripple unevenness and the nozzle attack properties were decreased by providing partition boards. It was found that the partition boards 50(*d*) illustrated in FIG. 13 was able to decrease the wind ripple unevenness and the nozzle attack properties, but the effect was not very good.

If Example 1 presented in Table 1, Examples 23 and 24 presented in Table 3, and Comparative Example 2 presented in Table 3, it was found that the flow rates of the gas influenced on the filling, the wind ripple unevenness, and the nozzle attack properties. In Example 23, since the flow rate of the gas was low, the plasma was not stably generated, and thunder-like electric discharge occurred. As a result, compared with Example 1, the effect of increasing the filling of the ink was decreased. In addition, in Example 24, since the flow rate of the gas was high and the gas was exhausted before nitrogen or oxygen was ionized, the plasma generation rate was low. Accordingly, the evaluation of the filling was decreased compared with Example 1. Meanwhile, since the air flow was great in Example 24, the wind ripple unevenness easily occurred compared with Example 1.

If Example 1 presented in Table 1 and Example 25 presented in Table 3 were compared, it was found that the types of the plasma irradiation section influenced on the wind ripple unevenness and the nozzle attack properties. In the same manner as in Example 25, if the line-shaped plasma irradiation section was used, the convection current of the gas was easily generated compared with the case in which the spot-shaped plasma irradiation section was used. As a result, compared with Example 1, the evaluation of the wind ripple unevenness and the nozzle attack properties were decreased.

If Example 1 presented in Table 1, Examples 26 and 27 presented in Table 3, and Comparative Example 2 presented in Table 3 were compared, the filling became better by the plasma irradiation. If Examples 1, 26, and 27 were compared, it was found that the evaluation of the filling was changed according to the types of the gas. In the mixed gas used in Example 1 in which the ratio of nitrogen and oxygen was 97:3, the effect of enhancing the hydrophilicity was excellent and the evaluation of the filling was high compared with the mixed gas in Example 26 or a single type of gas in Example 27.

The entire disclosure of Japanese Patent Application No. 2014-080519, filed Apr. 9, 2014 is expressly incorporated by reference herein.

What is claimed is:

1. An ink jet printer comprising:

a transportation mechanism that transports a medium in a first direction; and a carriage that has a plasma irradiation mechanism configured to irradiate at least a portion of the medium with plasma generated in an electricity discharge portion and emitted from a plasma irradiation opening and a head configured to eject ink from a nozzle to the portion of the medium irradiated with the plasma, and that moves in a second direction intersecting the first direction, wherein the plasma irradiation mechanism is provided on one side of the head in the second direction, wherein a partition board is provided between the plasma irradiation opening and the head, and wherein if a distance from a surface of the medium to the nozzle is (A), a distance from a surface of the medium to the plasma irradiation opening is (B), and a distance from a surface of the medium to the partition board is (C), a conditional expression: $(C)<(A)\leq(B)$ is satisfied.

2. The ink jet printer according to claim 1, wherein a conditional expression: $0.5\ \text{mm}\leq(C)<(A)\leq(B)\leq 10\ \text{mm}$ is satisfied.

3. The ink jet printer according to claim 1, wherein if a shortest distance between the nozzle and the partition board is (D), and a shortest distance between the nozzle and the plasma irradiation opening is (E), a conditional expression: $5\ \text{mm}\leq(D)<(E)\leq 500\ \text{mm}$ is satisfied.

4. The ink jet printer according to claim 1, wherein the partition board is disposed to correspond to the plasma irradiation opening.

5. The ink jet printer according to claim 1, wherein a length of the partition board in the first direction is longer than that of the head in the first direction.

6. The ink jet printer according to claim 1, wherein the plasma irradiation opening of the plasma irradiation mechanism is a spot type, and a plurality of the plasma irradiation openings are disposed in a line on one side of the head in the first direction, and wherein a plurality of the partition boards are disposed to correspond to the plurality of the plasma irradiation openings, respectively.

7. The ink jet printer according to claim 1, wherein the electricity discharge portion of the plasma irradiation mechanism is disposed so as not to be in contact with the medium.

8. The ink jet printer according to claim 1, wherein the same portion of the medium is irradiated with the plasma at least twice before the ink is attached.

9. An ink jet printer, comprising:

a transportation mechanism that transports a medium in a first direction; and a carriage that has a plasma irradiation mechanism configured to irradiate at least a portion of the medium with plasma generated in an electricity discharge portion and emitted from a plasma irradiation opening and a head configured to eject ink from a nozzle to the portion of the medium irradiated with the plasma, and that moves in a second direction intersecting the first direction, wherein the plasma irradiation mechanism is provided on both sides of the head in the second direction, wherein a partition board is provided between the plasma irradiation opening and the head, and wherein if a distance from a surface of the medium to the nozzle is (A), a distance from a surface of the medium to the plasma irradiation opening is (B), and a distance from a surface of the medium to the partition board is (C), a conditional expression: $(C)<(A)\leq(B)$ is satisfied.

10. The ink jet printer according to claim 9, wherein a conditional expression: $0.5\ \text{mm}\leq(C)<(A)\leq(B)\leq 10\ \text{mm}$ is satisfied.

11. The ink jet printer according to claim 9, wherein if the shortest distance between the nozzle and the partition board is (D), and if the shortest distance between the nozzle and the plasma irradiation opening is (E), a conditional expression: $5\ \text{mm}\leq(D)<(E)\leq 500\ \text{mm}$ is satisfied.

12. The ink jet printer according to claim 9, wherein the partition board is disposed to correspond to the plasma irradiation opening.

13. The ink jet printer according to claim 9, wherein a length of the partition board in the first direction is longer than that of the head in the first direction.

14. The ink jet printer according to claim 9, wherein the plasma irradiation opening of the plasma irradiation mechanism is a spot type, and a plurality of the plasma irradiation openings are disposed in a line on both sides of the head in the first direction, and wherein a plurality of the partition boards are disposed to correspond to the plurality of the plasma irradiation openings, respectively.

15. The ink jet printer according to claim 9, wherein the electricity discharge portion of the plasma irradiation mechanism is disposed so as not to be in contact with the medium.

16. The ink jet printer according to claim 9, wherein the same portion of the medium is irradiated with the plasma at least twice before the ink is attached.

* * * * *